United States Patent [19]

Bosch

[11] Patent Number: 4,663,842

[45] Date of Patent: May 12, 1987

[54] SHAVING APPARATUS

[75] Inventor: Sieds Bosch, Drachten, Netherlands

[73] Assignee: U.S. Philips Corporation, New York, N.Y.

[21] Appl. No.: 745,736

[22] Filed: Jun. 17, 1985

[30] Foreign Application Priority Data

Jun. 26, 1984 [NL] Netherlands ..... 8402007

[51] Int. Cl.[4] ..... B26B 19/16

[52] U.S. Cl. ..... 30/43.6; 384/244

[58] Field of Search ..... 30/43.6; 384/244, 245, 384/371

[56] References Cited

U.S. PATENT DOCUMENTS

| | | | |
|---|---|---|---|
| 1,976,181 | 10/1934 | Marti | 384/244 X |
| 3,890,705 | 6/1975 | Tietjens | 30/43.6 |
| 4,329,781 | 5/1982 | Schemmonn et al. | 30/43.6 X |
| 4,475,285 | 10/1984 | Hara et al. | 30/43.6 X |

*Primary Examiner*—E. R. Kazenske

*Assistant Examiner*—Michael D. Folkerts

*Attorney, Agent, or Firm*—Rolf E. Schneider

[57] ABSTRACT

A shaving apparatus comprises a housing; an external shaving member formed with hair-entry apertures and engaging the housing; and an internal shaving member associated with the external shaving member and rotatable relative thereto. A drive shaft couples the internal shaving member to a motor, the drive shaft having a hub. A pin engages the hub for rotatably supporting the drive shaft. Two separate radially acting cylindrical bearing surfaces of different diameters are provided on the pin. Two separate cylindrical radially acting bearing surfaces of correspondingly different diameters are provided on the hub for cooperation with the respective separate radially acting cylindrical bearing surfaces provided on the pin. A supporting plate is provided within the shaving apparatus housing, the pin and the supporting plate being formed as a one-piece plastic unit.

3 Claims, 1 Drawing Figure

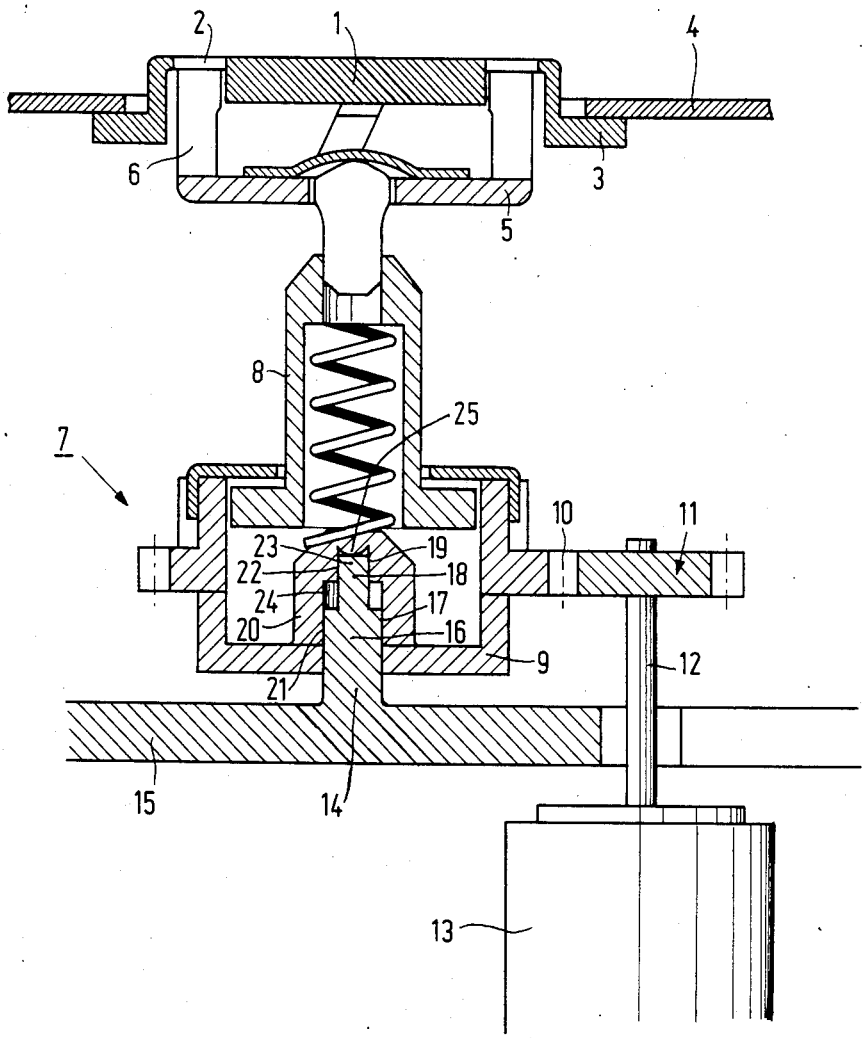
1
2
3
4
5
6
7
8
9
10
11
12
13
14
15
16
17
18
19
20
21
22
23
24
25

SHAVING APPARATUS

This invention relates to a shaving apparatus comprising an external shaving member formed with hair-entry apertures and an internal shaving member which is associated with and rotatable relative to the external shaving member and which is coupled to a motor by means of a drive shaft having a hub by means of which the drive shaft is rotatably supported on a pin.

Such a shaving apparatus is disclosed in U.S. Pat. No. 3,890,705. In this known shaving apparatus the hub is supported on a metal pin having one end secured in a plastic supporting plate.

It is the object of the present invention to provide a less expensive construction which is also easier to assemble and to this end the invention is characterized in that the hub is provided with at least two separate radially acting bearing surfaces of different diameters, which bearing surfaces cooperate with separate radially acting bearing surfaces of correspondingly different diameters on the pin.

The invention will now be described in more detail with reference to the accompanying drawing, in which:

The sole FIGURE is a sectional view of a part of a shaving apparatus.

Such apparatus includes an external shaving member 1 with hair-entry apertures 2. The external shaving member has a flanged portion 3 which engages the wall of the housing 4. An internal shaving member 5 comprises cutters 6 and is rotatable relative to the external shaving member 1. For this purpose the internal shaving member 5 is provided with a drive shaft 7 having a hollow shaft portion 8 and a hub 9. The hub 9 is formed with a gear ring 10 which meshes with a pinion 11 on the shaft 12 of an electric motor 13. The hub 9 is mounted for rotation about a pin 14 on a supporting wall 15 in the housing of the shavig apparatus. The pin 14 has a portion 16 provided with a radially acting cylindrical bearing surface 17 and a portion 18 of smaller diameter provided with a radially acting cylindrical bearing surface 19. The hub 9 includes a bearing portion 20 with a stepped bore which forms radially acting cylindrical bearing surfaces 21 and 22 of correspondingly different diameters. The radial bearing surfaces of different diameters provide a satisfactory centring of the hub on the pin without special accuracy requirements being imposed on the manufacture of the two parts.

By arranging the bearing surfaces 17 and 19 at a maximal axial distance from one another a high resistance is obtained to tilting moments exerted on the pin by the hub. Only a part of the surface of the pin 14 and the wall of the bore in the bearing portion 20 need be constructed as bearing surfaces, which yields a reduction in machining costs. By providing the bearing surface 19 of smaller diameter on the free end portion 23 of the pin 14, the hub 9 can be mounted simply on the pin 14.

An annular space 24 which is formed between the bearing portion 20 of the hub and the pin 14 may now be used effectively for the storage of a lubricant.

Preferably, the pin 14 and the supporting wall 15 are manufactured as an integral unit from a plastic material. Thus, the manufacture of the pin as a separate part and the operation of mounting this pin in the supporting wall may be dispensed with. The bearing surface 19 of smaller diameter on the free end portion 23 of the pin 14 has such a shape that it is easy to release from the die when said integral unit is made of a plastic. The free end portion 23 of the pin may bear axially against a domed protrusion 25 on the end wall of the bearing portion 20 so that the hub and the pin also constitute a thrust bearing.

What is claimed is:

1. A shaving apparatus which comprises a housing; an external shaving member formed with hair-entry apertures and engaging said housing; an internal shaving member associated with the external shaving member and rotatable relative thereto; a motor; a drive shaft coupling the internal shaving member to the motor, said drive shaft having a hub; a pin engaging said hub for rotatably supporting the drive shaft; two separate radially acting cylindrical bearing surfaces of different diameters provided on the pin; two separate cylindrical radially acting bearing surfaces of correspondingly different diameters provided on the hub for cooperation with the respective separate radially acting cylindrical bearing surfaces provided on said pin; and a supporting plate within the shaving apparatus housing, said pin and said supporting plate being formed as a one-piece plastic unit.

2. A shaving apparatus according to claim 1, in which the axial length of the wider diameter bearing surface provided on the hub is greater than the axial length of the corresponding wider diameter bearing surface provided on the pin, an enclosed annular space thereby being formed between the hub and the pin for the storage of a lubricant.

3. A shaving apparatus according to claim 1, in which the hub and the pin also constitute a thrust bearing.

* * * * *